United States Patent [19]

Kieber

[11] 4,354,574

[45] Oct. 19, 1982

[54] OIL SUCTION APPARATUS

[75] Inventor: Lothar Kieber, Mülheim, Fed. Rep. of Germany

[73] Assignee: Deutsche Calypsolgesellschaft mbH & Co., Düsseldorf, Fed. Rep. of Germany

[21] Appl. No.: 121,611

[22] Filed: Feb. 14, 1980

[30] Foreign Application Priority Data

Feb. 22, 1979 [DE] Fed. Rep. of Germany ... 7904993[U]

[51] Int. Cl.[3] ..... F16N 37/00

[52] U.S. Cl. ..... 184/1.5; 137/205; 137/565; 137/899

[58] Field of Search ..... 184/1.5; 137/625.11, 137/625.15, 625.41, 565, 899, 205

[56] References Cited

U.S. PATENT DOCUMENTS

| | | | |
|---|---|---|---|
| 1,884,820 | 10/1932 | Osborne | 184/1.5 X |
| 3,095,062 | 6/1963 | Neely | 184/1.5 |
| 3,867,999 | 2/1975 | Cox | 184/1.5 |
| 4,095,673 | 6/1978 | Takeuchi | 184/1.5 |
| 4,226,267 | 10/1980 | Meacham, Jr. | 137/565 |

*Primary Examiner*—Alan Cohan
*Assistant Examiner*—John A. Rivell
*Attorney, Agent, or Firm*—Martin A. Farber

[57] ABSTRACT

Apparatus for the suction of oil from an oil sump of a motor vehicle through the dipstick opening, comprises a wheeled frame which supports an oil storage container and an electric pump having an oil outlet duct leading to the oil storage container. Three dipstick suction probes of different sizes are connected to the pump via valve means for actuating each said probe independently of the other probes.

2 Claims, 2 Drawing Figures

OIL SUCTION APPARATUS

BACKGROUND OF THE INVENTION

1. Field of the Invention

The invention relates to apparatus for the suction of oil from a sump of a motor vehicle through the dipstick opening.

2. Description of the Prior Art

There has been proposed apparatus for the withdrawal of oil from an oil sump of a motor vehicle, comprising a wheeled frame which removably supports an oil storage container and which carries an electric pump to which is connected a dipstick suction probe, and an oil outlet duct leading to the oil storage container.

When such apparatus is to be used with various different motor vehicles, it is necessary to select a dipstick suction probe suitable for the type of vehicle, and consequently to change it on the apparatus. Alternative probes and adapters are provided for the purpose. Handling the alternative probes is inconvenient and dirty. The oil-soiled suction probe mounted on the apparatus must be taken off the suction duct of the pump; then another probe suitable for the type of motor vehicle concerned must be fitted before the apparatus can be used with that vehicle.

SUMMARY OF THE INVENTION

According to the invention there is provided apparatus for the suction of oil from an oil sump of a motor vehicle through the dipstick opening, said apparatus comprising a wheeled frame, an oil storage container removably mounted on the frame, an electric pump carried by the frame, means defining an oil outlet duct leading from the pump to the oil storage container, three dipstick suction probes of different sizes connected to the pump, and means for actuating each said probe independently of the other said probes.

Further according to the invention, there is provided apparatus for withdrawing oil from an oil sump of a motor vehicle through a dipstick opening, said apparatus comprising a trolley, an oil container carried by the trolley, an electric pump carried by the trolley, said pump having an inlet and an outlet, said outlet communicating with the oil container, a plurality of dipstick suction probes of different sizes, valve means connecting the probes to the pump inlet, said valve means being manually controllable to provide communication between a selected one of the probes and the pump inlet while isolating the remainder of the probes from the pump inlet.

Preferably, a three-way valve is incorporated in a suction duct of the pump, and is connected by means of flexible hoses with the dipstick suction probes, respectively. By means of a switch it is then possible for the user to effect as he chooses the connection between the suction duct of the pump and the dipstick suction probe suitable for the vehicle in question, it being ensured by means of the corresponding mechanical closure means of the valve that no air is sucked into the pump via the other probes remaining not in use. Instead of the three-way valve it is possible to use three separate probe switches with corresponding ducting to the pump.

To avoid being dependent upon an external power supply, the chassis of the oil suction apparatus preferably carries a battery case with a 12 volt battery under the removable oil storage container.

Advantageously, the pump is an eccentrically-mounted rotary vane pump with an automatic switch-off device, which has a time relay actuatable by a pressure switch incorporated in the outlet duct of the pump, so that the pump is automatically switched-off when all of the oil has been sucked out of the oil sump. The pump, the three-way valve and the automatic switch-off device are, in a practical embodiment of the invention, assembled as a constructional unit in a control box which is easily removably mounted on a support of the frame, and is additionally provided with a charging plug for the battery.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENTS

Figure 1:
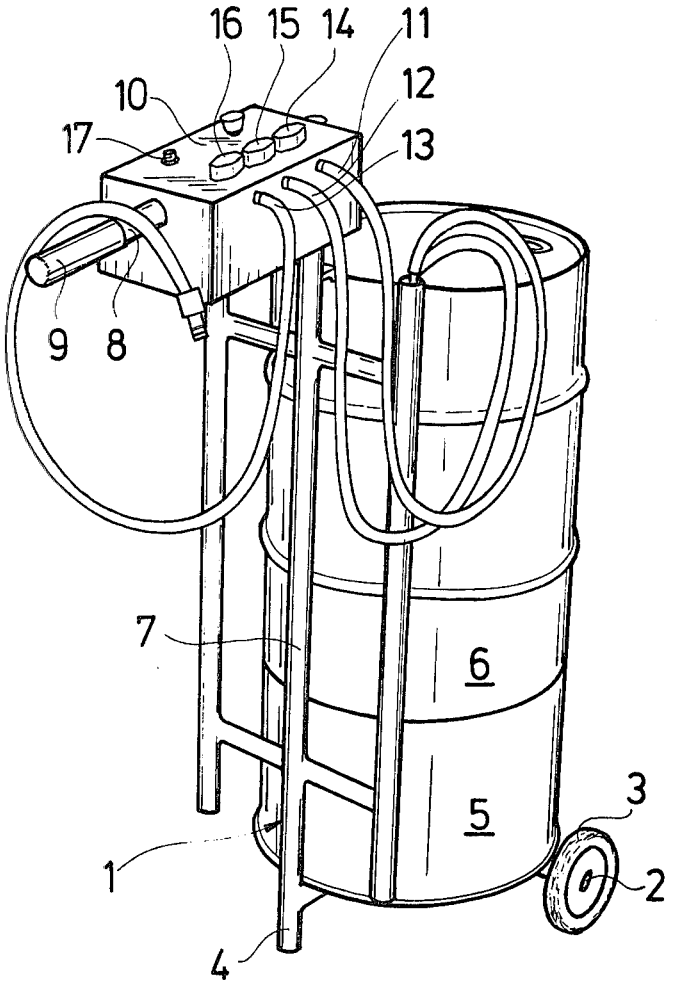
FIG. 1 is a perspective view of oil suction apparatus in accordance with the invention.

The oil suction apparatus shown in FIG. 1 of the drawing, consists of a movable frame or trolley 1 which is fabricated from tubular material and which is constructed at the bottom in the manner of a tripod, with two wheels 3 mounted on a front axle 2, and a leg 4 at the back. The frame 1 carries a cylindrical battery case 5, into which a lead-acid accumulator (storage battery), for example of 12 Volt output, is incorporated. A standard oil container 6 is disposed as an oil storage container on the battery case 5. The oil container 6 is removably fixed in an easily releasable manner to the frame 1. In this arrangement the fixing is such that even when the frame 1 is tilted and when the oil suction apparatus as a whole is being transported there is no danger of its changing its position.

The leg 4 of the frame is upwardly extended by a tube 7 onto which a holding arm 8, terminating in a handle 9, is welded. A control box 10 is pushed onto the arm 8 and is fixed with two screws, not shown. In the control box the basic parts of the suction equipment as well as the control elements are assembled as a constructional unit.

Figure 2:
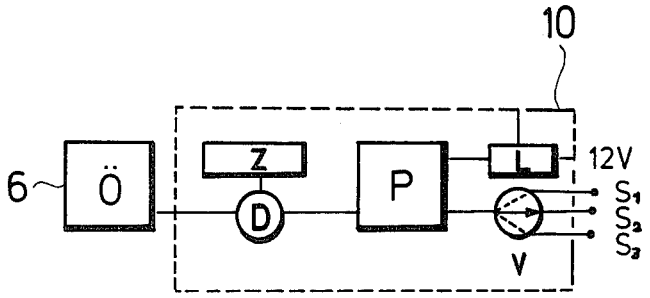
FIG. 2 is a block diagram showing the individual parts of the apparatus.

As schematically indicated in FIG. 2, the control box 10 contains an eccentrically-mounted rotary vane pump P with a capacity of 4.5 liters per minute at 80° C. oil temperature, the pump P being powered by the 12 V battery. The rotary vane pump P is equipped with an automatic switching device comprising a pressure monitor switch D incorporated in the pressure or outlet duct, and a time relay Z, the switching device serving to switch-off the pump when the used oil has been completely sucked out of a motor vehicle engine. The pressure duct is connected to the oil storage container 6 which is marked O in FIG. 2.

In the control box 10 there is also mounted a three-way valve V incorporated in the suction duct of the pump P, to which valve three dipstick suction probes S1, S2 and S3 are connected via flexible hoses 11, 12, and 13. The probe S1 has a diameter of 5 mm, probe S2 a diameter of 6 mm, and probe S3 is fitted with an adaptor for connection to special types of motor vehicle. With these three probes, all motor car engines can be serviced.

On the upper side of the control box 10 three switches 14, 15, 16 are mounted for actuating the valve V. Also, a signal lamp 17 is provided to indicate when the apparatus has switched-off, this taking place automatically when the oil suction process is completed. The control box 10 can be easily changed and exchanged, and this facilitates maintenance.

With further reference to FIG. 2, in addition to the parts already mentioned, the control box 10 includes a charging plug L for recharging the battery, without the latter having to be taken out of the battery case 5.

In use, a driver who intends to effect an engine oil change on his motor vehicle at the gas station, transports the apparatus on the wheels 3 to his vehicle, the user holding the apparatus by means of the handle 9. Then, with reference to a chart on the control box 10 he chooses the dipstick probe appropriate to his type of vehicle and introduces it into the sump of the engine through the dipstick tube. Then, he actuates the relevant switch 14, 15 or 16 to effect the operative connection of the chosen suction probe with the pump. The suction process takes place and ends automatically when the used oil has been completely sucked out of the engine. The signal lamp 17 indicates this process. The driver then operates the switch, returning it to the closed position, removes the suction probe from the dipstick tube and inserts it into the appropriate holder on the apparatus. Then, he fills up with fresh oil, checks with the dipstick, and has carried out a perfect oil change simply, quickly and cleanly.

The apparatus particularly described is independent of an external power supply, and affords the possibility of selecting the suction probe suited to the type of vehicle without the necessity of changing the probe on the apparatus. Operation and maintenance of the apparatus can be carried out by an untrained person in a simple, quick and clean manner. Suction probes no longer require to be changed and it is not necessary to take apart the suction duct of the pump. Residual oil does not drip onto the ground.

What is claimed is:

1. Apparatus for the suction of oil from an oil sump of a motor vehicle through a dipstick opening, said apparatus comprising a wheeled frame, an oil storage container removably mounted on the frame, an electric pump carried by the frame, means defining an oil outlet duct leading from the pump to the oil storage container, a three-way valve means connected to a suction side of the pump, three dipstick suction probes of different sizes, three flexible hoses permamently connected to said three-way valve and to said three dipstick suction probes, respectively, said three-way valve means for actuating each said suction probe, respectively, independently of the other of said probes, said frame comprises, a vertically extending leg forming a tube at its upper end, a holding arm extending horizontally from and connected to said tube at the upper end thereof forming an L-shaped therewith, a handle is connected to free end of said holding arm, an axle having wheels on opposite ends thereof, a bottom cross-member connected to a lower portion of said leg and centrally to said axle, said leg and said wheels form a three-point support, two vertical side members disposed on lateral sides of said tube extending parallel thereto and connected therewith, said side members have bottoms disposed higher than the lower portion of said leg and defining open upper ends disposed lower than said upper end of said tube, said suction probes being adapted to be inserted in said open upper ends, a control box containing said pump and valve means is inserted on said holding arm adjacent said tube and removably secured to said handle, said battery case being supported on said front axle and said cross member, said oil container being supported on said battery case, said oil container and said battery case being cylindrical with substantially the same diameter.

2. Apparatus for withdrawing oil from an oil sump of a motor vehicle through a dipstick opening, said apparatus comprising a trolley frame, an oil container carried by the trolley, an electric pump carried by the trolley frame, said pump having an an inlet and an outlet, said outlet communicating with the oil container, a plurality of dipstick suction probes of different sizes, valve means permanently connecting the probes to the pump inlet, said valve means being manually controllable to provide communication between a selected one of the probes and the pump inlet while isolating the remainder of the probes from the pump inlet, said frame comprises, a vertically extending leg forming a tube at its upper end, a holding arm extending horizontally from and connected to said tube at the uper end thereof forming an L-shape therewith, a handle is connected to free end of said holding arm, an axle having wheels on opposite ends thereof, a bottom cross-member connected to a lower portion of said leg and centrally to said axle, said leg and said wheels form a three-point support, two vertical side members disposed on lateral sides of said tube extending parallel thereto and connected therewith, said side members have bottoms disposed higher than the lower portion of said leg and defining open upper ends disposed lower than said upper end of said tube, said suction probes being adapted to be inserted in said open upper ends, a control box containing said pump and valve means is inserted on said holding arm adjacent said tube and removably secured to said handle, said battery case being supported on said front axle and said cross member, said oil container being supported on said battery case, said oil container and said battery case being cylindrical with substantially the same diameter.

* * * * *